US010249953B2

(12) United States Patent
Ng et al.

(10) Patent No.: US 10,249,953 B2
(45) Date of Patent: Apr. 2, 2019

(54) DIRECTIVE FIXED BEAM RAMP EBG ANTENNA

(71) Applicant: Raytheon Company, Waltham, MA (US)

(72) Inventors: Jackson Ng, Tucson, AZ (US); Charles G. Gilbert, Tucson, AZ (US); Jack H. Anderson, Tucson, AZ (US); Robyn Jimenez, Vail, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 354 days.

(21) Appl. No.: 14/936,711

(22) Filed: Nov. 10, 2015

(65) Prior Publication Data

US 2017/0133762 A1 May 11, 2017

(51) Int. Cl.

| | |
|---|---|
| ***H01Q 1/12*** | (2006.01) |
| ***H01Q 9/04*** | (2006.01) |
| ***H01Q 1/42*** | (2006.01) |
| ***H01Q 1/48*** | (2006.01) |
| ***H01Q 1/28*** | (2006.01) |
| ***H01Q 15/00*** | (2006.01) |

(52) U.S. Cl.

CPC ..... *H01Q 9/0407* (2013.01); *H01Q 1/12* (2013.01); *H01Q 1/286* (2013.01); *H01Q 1/42* (2013.01); *H01Q 1/48* (2013.01); *H01Q 9/0421* (2013.01); *H01Q 15/008* (2013.01)

(58) Field of Classification Search

CPC ..... H01Q 9/0407
USPC ..... 343/872
See application file for complete search history.

(56) References Cited

U.S. PATENT DOCUMENTS

| | | | | |
|---|---|---|---|---|
| 2,817,086 A | | 12/1957 | Kelly et al. | |
| 4,063,248 A | | 12/1977 | Debski et al. | |
| 4,132,995 A | * | 1/1979 | Monser | H01Q 1/286 343/767 |
| 4,197,544 A | * | 4/1980 | Kaloi | H01Q 1/48 343/700 MS |

(Continued)

FOREIGN PATENT DOCUMENTS

| | | |
|---|---|---|
| FR | 2 691 014 | 11/1993 |
| WO | WO 02/052674 A1 | 7/2002 |

OTHER PUBLICATIONS

Rahmat-Samii; The Marvels of Electromagnetic Band Gap (EBG) Structures: Novel Microwave and Optical Applications; Microwave and Optoelectronics Conference; Sep. 20, 2003; 11 Pages.

(Continued)

*Primary Examiner* — Andrea Lindgren Baltzell
(74) *Attorney, Agent, or Firm* — Daly Crowley Mofford & Durkee LLP

(57) ABSTRACT

A fixed beam ramp electromagnetic band gap (EBG) antenna including a radiating element and an electromagnetic band gap (EBG) structure both disposed within a ramped cavity. The cavity is designed with the ramp leading to the EBG structure disposed about a base of the cavity. The radiating element can be disposed above the EBG structure and the EBG structure may have a plurality of unit cells. The EBG structure can be provided both, horizontally on the floor of the cavity and vertically along a back wall of the cavity. The use of both horizontal and vertical EBG structures combined with the ramped cavity increases the bandwidth and enhances the beam steering of the antenna system.

20 Claims, 4 Drawing Sheets

(56) References Cited

U.S. PATENT DOCUMENTS

| | | | | |
|---|---|---|---|---|
| 4,287,518 | A | 9/1981 | Ellis, Jr. | |
| 4,415,900 | A * | 11/1983 | Kaloi | H01Q 13/18 343/700 MS |
| 4,427,984 | A | 1/1984 | Anderson | |
| 4,716,415 | A | 12/1987 | Kelly | |
| 5,264,860 | A | 11/1993 | Quan | |
| 5,361,049 | A | 11/1994 | Rubin et al. | |
| 5,506,589 | A | 4/1996 | Quan et al. | |
| 5,892,485 | A * | 4/1999 | Glabe | H01Q 19/108 343/756 |
| 6,052,889 | A | 4/2000 | Yu et al. | |
| 6,175,337 | B1 | 1/2001 | Jasper, Jr. et al. | |
| 6,271,799 | B1 | 8/2001 | Rief et al. | |
| 6,366,254 | B1 | 4/2002 | Sievenpiper et al. | |
| 6,433,756 | B1 * | 8/2002 | Sievenpiper | H01Q 1/38 343/700 MS |
| 6,496,115 | B2 | 12/2002 | Arakawa | |
| 6,518,930 | B2 | 2/2003 | Itoh et al. | |
| 6,545,647 | B1 | 4/2003 | Sievenpiper et al. | |
| 6,670,921 | B2 | 12/2003 | Sievenpiper et al. | |
| 6,952,190 | B2 | 10/2005 | Lynch et al. | |
| 7,145,518 | B2 | 12/2006 | Tanaka et al. | |
| 7,307,596 | B1 | 12/2007 | West | |
| 7,522,105 | B1 | 4/2009 | LaComb | |
| 7,855,689 | B2 * | 12/2010 | Fukui | H01Q 1/241 343/731 |
| 7,884,778 | B2 | 2/2011 | Wu et al. | |
| 2004/0174314 | A1 * | 9/2004 | Brown | H01Q 3/46 343/767 |
| 2004/0233112 | A1 | 11/2004 | Aisenbrey | |
| 2005/0068233 | A1 | 3/2005 | Tanaka et al. | |
| 2007/0224737 | A1 | 9/2007 | Berlin et al. | |
| 2009/0295665 | A1 | 12/2009 | Orton et al. | |
| 2009/0303128 | A1 | 12/2009 | Robert et al. | |
| 2010/0039343 | A1 | 2/2010 | Uno et al. | |
| 2011/0050527 | A1 | 3/2011 | Anderson et al. | |
| 2013/0241788 | A1 | 9/2013 | Anderson et al. | |
| 2013/0241791 | A1 | 9/2013 | Anderson et al. | |
| 2015/0029062 | A1 | 1/2015 | Ng et al. | |
| 2015/0130673 | A1 | 5/2015 | Ng et al. | |

OTHER PUBLICATIONS

PCT Search Report and Written Opinion of the ISA for PCT/US2016/041874 dated Mar. 31, 2017; 15 Pages.
Response dated Nov. 18, 2015 to Office Action dated Aug. 19, 2015; For U.S. Appl. No. 14/077,409; 16 pages.
Notice of Allowance dated Jan. 7, 2016; For U.S. Appl. No. 14/077,409; 9 pages.
Office Action dated Jan. 30, 2014; For U.S. Appl. No. 13/457,546; 20 pages.
Applicant Initiated Interview Request Form dated Apr. 23, 2014; For U.S. Appl. No. 13/457,546; 3 pages.
Response dated Apr. 25, 2014 to Office Action dated Jan. 30, 2014; For U.S. Appl. No. 13/457,546; 27 pages.
Terminal Disclaimer filed Apr. 25, 2014; For U.S. Appl. No. 13/457,546; 2 pages.
Supplemental Amendment dated Apr. 29, 2014 to Response dated Apr. 25, 2014 to Office Action dated Jan. 1, 2014; For U.S. Appl. No. 13/457,546; 26 pages.
Applicant-Initiated Interview Summary dated May 12, 2014; For U.S. Appl. No. 13/457,546; 3 pages.
Final Office Action dated Jul. 14, 2014; For U.S. Appl. No. 13/457,546; 18 pages.
Applicant Initiated Interview Request Form dated Sep. 23, 2014; For U.S. Appl. No. 13/457,546; 3 pages.
Applicant-Initiated Interview Summary dated Oct. 1, 2014; For U.S. Appl. No. 13/457,546; 3 pages.
Response dated Oct. 14, 2014 to Final Office Action dated Jul. 14, 2014; For U.S. Appl. No. 13/457,546; 15 pages.
Notice of Appeal dated Oct. 14, 2014; For U.S. Appl. No. 13/457,546; 1 page.
Advisory Action Before the Filing of an Appeal Brief dated Nov. 14, 2014; For U.S. Appl. No. 13/457,546; 3 pages.
Advisory Action Before the Filing of an Appeal Brief dated Nov. 28, 2014; For U.S. Appl. No. 13/457,546; 3 pages.
Appeal Brief dated Jan. 24, 2015 in Response to Final Office Action dated Jul. 14, 2014; For U.S. Appl. No. 13/457,546; 41 pages.
Notification of Non-Compliant Appeal Brief dated Mar. 2, 2015; For U.S. Appl. No. 13/457,546; 3 pages.
Response dated Mar. 17, 2015 to Notification of Non-Compliant Appeal Brief dated Mar. 2, 2015; For U.S. Appl. No. 13/457,546; 6 pages.
Examiner's Answer dated Sep. 1, 2015 in Response to Appeal Brief dated Jan. 14, 2015; For U.S. Appl. No. 13/457,546; 13 pages.
Reply Brief dated Oct. 15, 2015 to Examiner's Answer dated Sep. 1, 2015; For U.S. Appl. No. 13/457,546; 10 pages.
Patent Trial and Appeal Board Docketing Notice dated Nov. 6, 2015; For U.S. Appl. No. 13/457,546; 2 pages.
Office Action dated Jan. 30, 2014; For U.S. Appl. No. 13/457,547; 22 pages.
Applicant Initiated Interview Request Form dated Apr. 24, 2014; For U.S. Appl. No. 13/457,547; 3 pages.
Response dated May 1, 2014 to Office Action dated Jan. 30, 2014; For U.S. Appl. No. 13/457,547; 28 pages.
Applicant-Initiated Interview Summary dated May 12, 2014; For U.S. Appl. No. 13/457,547; 3 pages.
Final Office Action dated Jul. 14, 2014; For U.S. Appl. No. 13/457,547; 19 pages.
Applicant-Initiated Interview Summary dated Oct. 2, 2014; For U.S. Appl. No. 13/457,547; 3 pages.
Response dated Oct. 14, 2014 to Final Office Action dated Jul. 14, 2014; For U.S. Appl. No. 13/457,547; 15 pages.
Notice of Appeal dated Oct. 14, 2014; For U.S. Appl. No. 13/457,547; 1 page.
Appeal Brief dated Jan. 14, 2015 in Response to Final Office Action dated Jul. 14, 2014; For U.S. Appl. No. 13/457,547; 43 pages.
Advisory Action Before the Filing of an Appeal Brief dated Mar. 26, 2015; For U.S. Appl. No. 13/457,547; 3 pages.
Examiner's Answer dated Jun. 3, 2015 in Response to Appeal Brief dated Jan. 14, 2015; For U.S. Appl. No. 13/457,547; 13 pages.
Reply Brief dated Jul. 31, 2015 to Examiner's Answer dated Jun. 3, 2015; For U.S. Appl. No. 13/457,547; 10 pages.
Patent Trial and Appeal Board Docketing Notice dated Aug. 10, 2015; For U.S. Appl. No. 13/457,547; 2 pages.
Office Action dated Aug. 19, 2015; For U.S. Appl. No. 14/077,409; 14 pages.
PCT International Search Report and Written Opinion of the ISA dated Apr. 18, 2013; For PCT App. No. PCT/US2012/067587; 12 pages.
PCT International Search Report and Written Opinion of the ISA dated Apr. 23, 2013; For PCT App. No. PCT/US2012/067582; 11 pages.
PCT International Preliminary Report on Patentability and Written Opinion of the ISA dated Sep. 25, 2014; For PCT App. No. PCT/US2012/067587; 6 pages.
PCT International Preliminary Report on Patentability and Written Opinion of the ISA dated Sep. 25, 2014; For PCT App. No. PCT/US2012/067582; 6 pages.
European Patent Office Intention to Grant dated Apr. 13, 2015; For European Pat. App. No. 12 816.164.3-1812; 37 pages.
European Patent Office Intention to Grant dated Apr. 14, 2015; For European Pat. App. No. 12 799 472.1-1812; 25 pages.
Bell, Jodie M. et al.; "A Low-Profile Archimedean Spiral Antenna Using an EBG Ground Plane;" IEEE Antennas and Wireless Propagation Letters, vol. 3, 2004; pp. 223-226 (4 pages).
"Chapter 13: Waveguides;" *Naval Shore Electronics Criteria: Installation Standards and Practices,* Department of the Navy, Navel Electronic Systems Command, Washington, D.C., Jun. 1972; pp. 13-1-13-31 (32 pages).
Chun et al.; "Modeling and Characterization of Cavity Backed Circular Aperture Antenna with Suspended Stripline Probe Feed;" NASA Glen Research Center, Jun. 2000; pp. 1-4 (10 pages).

(56) References Cited

OTHER PUBLICATIONS

Demarest, Kenneth; "Waveguide: Waveguide Modes;" *The Electronics* Handbook, CRC Press with IEEE Press, 1996; pp. 259-269 (12 pages).
Lai, Anthony et al.; "Infinite Wavelength Resonant Antennas with Monopolar Radiation Pattern Based on Periodic Structures;" IEEE Transaction on Antennas and Propagation, vol. 55, No. 3, Mar. 2007; pp. 868-876 (9 pages).
Palmer, Katie M.; "Intellectual Ventures Invents Beam-Steering Metamaterials Antenna;" IEEE Spectrum, Nov. 30, 2011; 2 pages.
Rammos, E.; "A New Wideband, High Gain Suspended Substrate Line Planar Array for 12 GHz Satellite.T.V.;" IEEE 13$^{th}$ Annual Microwave Conference, Sep. 1983; pp. 227-231 (5 pages).
Decision on appeal dated Mar. 30, 2017 for U.S. Appl. No. 13/457,547; 7 pages.
Notice of Allowance dated Jun. 16, 2017 for U.S. Appl. No. 13/457,547; 12 pages.
Decision on appeal dated Aug. 25, 2017 for U.S. Appl. No. 13/457,546; 5 pages.
Notice of Allowance dated Sep. 6, 2017 for U.S. Appl. No. 13/457,546; 9 pages.
European Response dated Nov. 20, 2018 for European Application No. EP16829339.7; 12 Pages.

* cited by examiner

DIRECTIVE FIXED BEAM RAMP EBG ANTENNA

BACKGROUND

As is known in the art, aircrafts, missiles, satellites and other aerial platforms often utilize an antenna to establish communication links with a ground-based platform (e.g., a deployment platform). Then, such antennas provide an antenna beam generally directed toward its launch point, meaning significant steering from broadside.

As is also known, there is a trend to provide such antennas with increasingly wider bandwidth, higher gain while at the same time being "flush mounted" to a surface of the aerial platform (e.g., the missile "skin") and packaged in a limited volume. The benefits of a flush mounted and volume-limited antenna include minimizing its aerodynamic effect and reducing or ideally minimizing mass impact (that is, a smaller antenna may weigh less and consequently reduce the overall weight of the missile or aircraft or other aerial platform on which it is mounted).

SUMMARY

The subject matter described herein relates to ramp electromagnetic bandgap (EBG) antenna designs capable of providing improved fixed beam steering with high gain, wide bandwidth, flush-mounted, and from a relatively small, low profile package. In various embodiments described herein, antennas are provided that include a radiating element held in a fixed orientation and disposed about a horizontal EBG structure and perpendicular to a vertical EBG structure. The radiating element and both the horizontal and vertical EBG structure are mounted within a ramped cavity. The use of the vertical EBG structures combined with the above mentioned features increases the bandwidth and enhances beam steering.

In accordance with one aspect of the concepts, systems, circuits, and techniques described herein, a system for a fixed beam ramp electromagnetic band gap (EBG) antenna comprises a substrate having first and second opposing surfaces with the first surface having a cavity provided therein. The cavity can have a ramp portion and a base portion. A ground plane may be disposed over selected portions of the first surface away from the cavity and an EBG structure is disposed about the base portion of the cavity. The EBG structure comprises a number of unit cells, also referred to as EBG elements, arranged in rows and columns. A radiating element may be disposed above the EBG structure.

In some embodiments, the cavity further comprises a back wall coupled to the base portion and two side walls such that a height of the back wall and the two side walls is equal to a highest point of the ramp portion. The EBG structure may include a horizontal portion and a vertical portion. The horizontal portion is positioned along the base portion of the cavity and the vertical portion is positioned along the back wall of the cavity. The base portion of the cavity may be parallel with the ground plane of the substrate.

In some embodiments, the radiating element may be positioned parallel with respect to the horizontal portion of the EBG structure and perpendicular to the vertical portion of the EBG structure. A dielectric layer positioned between the radiating element and the EBG structure. In some embodiments, dielectric material may be disposed or positioned between each unit cell of the EBG structure. A feed circuit can be coupled to the radiating element through the ground plane of the substrate and the EBG structure.

In some embodiments, a radome is disposed over the radiating element to cover an upper surface of the radiating element. The radome may be disposed such that an upper surface of the radome is substantially flush with an upper surface of the cavity.

In accordance with one aspect of the concepts, systems, circuits, and techniques described herein, a system for a fixed beam ramp electromagnetic band gap (EBG) antenna comprises a substrate having first and second opposing surfaces with the first surface having a cavity provided therein. The cavity may have a base portion and a back wall. A ground plane may be disposed over selected portions of the first surface away from the cavity and an EBG structure may be disposed about the base portion of the cavity and the back wall of the cavity. In some embodiments, the EBG structure comprises a number of unit cells arranged in rows and columns and a radiating element may be disposed above the EBG structure.

In one embodiments, the cavity further comprises a ramp portion. The ramp portion may extend downward to the base portion such that a height of the back wall and two side walls of the cavity is equal to a highest point of the ramp portion.

BRIEF DESCRIPTION OF THE DRAWINGS

The foregoing features may be more fully understood from the following description of the drawings in which.

DETAILED DESCRIPTION

Figure 1:
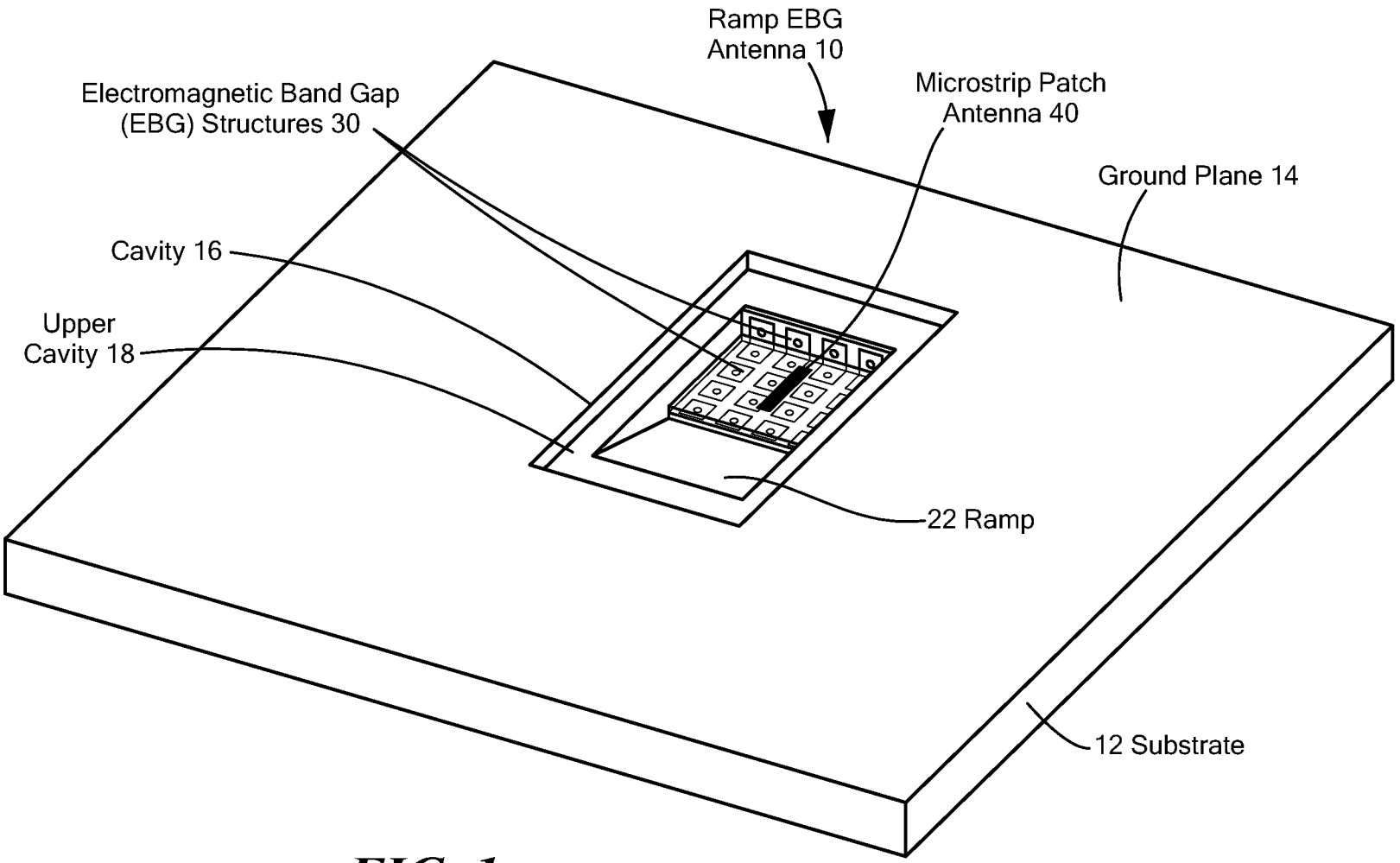
FIG. 1 is an isometric view of a directive fixed beam ramp electromagnetic band gap (EBG) antenna system in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and are part of this disclosure.

The subject matter described herein is directed to an antenna system that includes a microstrip patch antenna and an electromagnetic band gap (EBG) structure that are both disposed within a ramped cavity. In some embodiments, the microstrip patch antenna is provided as a relatively narrow half-wavelength microstrip patch antenna. Other microstrip antenna configurations may also be used depending upon the needs of the particular application. The EBG structures are provided both, horizontally on the base or floor of the cavity and vertically along the back wall of the cavity. The cavity is designed with the ramp leading to the EBG structures on the cavity floor. In an embodiment, the EBG structures on the bottom and the wall of the ramped cavity act as a high impedance surface to help steer the beam. The microstrip patch antenna provides a very low profile radiating mechanism. Additionally, the EBG structure is a physically realizable magnetic conductor that has at least two critical features: in-phase reflection and surface-wave band gap. These features provide wide bandwidth, high gain, and beam-steering inside the flush-mounted cavity. In some embodiments, the entire structure fits within a volume-limited form factor. For example and without limitation, the volume of the design may include a length equal to 1.3*wavelength, a width equal to 0.69*wavelength, and a height equal to 0.24*wavelength (i.e., L=1.3*λ, W=0.69*λ, H=0.24*λ). The ramped cavity wall helps facilitate and enhance the end-fire nature of this antenna structure. The use of the vertical EBG structures combined with the ramped cavity increases the bandwidth and enhances the beam steering of the antenna system.

As stated above, the high gain, wide bandwidth, and greater beam steering is a result from properly designing the radiating mechanism, the horizontal and vertical EBG structure, and an appropriate ramped cavity size. The boundary condition of ramped cavity walls create images of the EBG structure within the XY plane, i.e. images of the rows and columns are repeated. As a result, the effective radiating aperture area increases, hence increased gain and bandwidth. Moreover, the combination of the radiating mechanism, its position, the horizontal and vertical EBG structures, the cavity size, and a high dielectric constant provides an increased beam steering capability. This beam steering is a result of the overall constructive/destructive interference of the following radiating components: radiation from the radiation mechanism (its position and high dielectric constant impacts this), radiation of both the horizontal and vertical EBG structure (the high dielectric constant impacts this as well), and lastly, the radiation from the edges of the cavity walls and the ramped cavity shape.

It is recognized herein that different beam steering responses can be achieved by appropriate design of the radiating element, its position, the EBG structure, a dielectric constant, and the ramped design of the cavity. Accordingly, while one exemplary combination of elements is described herein to provide increased beam steering, it should be understood that many other combinations exists as well and after reading the disclosure provided herein, a person of ordinary skill in the art will understand how to provide an antenna having a desired beam steering characteristic. For example, in some embodiments, the position of the radiating mechanism (i.e., the narrow patch antenna) within the ramped cavity, the presence of the horizontal and vertical EBG structures, a high dielectric constant material (i.e., Rogers TMM10i), and the cavity shape can be modified or altered to enhance performance of the ramp EBG (REBG) antenna system.

The ramp EBG antenna designs are particularly well suited for use in antenna applications requiring flush mounting (e.g., airborne applications, conformal arrays, etc.). In some embodiments, the entire antenna structure, including a radome, can be flush-mounted into a cavity to minimize aerodynamic impact within a small volume that can be supported on small missile airframe. The ramp EBG antenna designs are also well suited for use in other applications where small antenna size is desired, such as hand held wireless communicators and wireless networking products. The antenna designs may be used for most datalinks systems. In some embodiments, the conductive cavity may include, for example, a depression within an outer conductive skin of a vehicle (e.g., a ground vehicle, an aircraft, a missile, a spacecraft, a watercraft, etc.). It should be noted that the antennas and techniques described herein are not limited to use in flush mounted applications and not limited to mobile applications.

Referring now to FIG. 1, an illustrative ramp EBG antenna system 10 includes a substrate 12 having a ground plane 14 disposed over a first surface thereof and a cavity 16 formed or otherwise provided therein. The substrate 12 may be provided from conventional dielectric materials such that ramp EBG antenna 10 may be provided using conventional fabrication processes such that ramp EBG antenna 10 may be mass produced at low cost. Those of ordinary skill in the art will appreciate how to select a substrate material to suit the needs of a particular application. The ground plane 16 may be a conductive surface and can be disposed over a first surface (i.e., top surface) of the substrate 12. In some embodiments, the ground plane 14 may be disposed over selective portions of the first surface of the substrate 12 excluding the cavity 16 portion of the substrate 12. In other embodiments, the ground plane 16 may be disposed over a second surface (i.e., bottom surface, base) of the substrate 12.

Figure 2A:
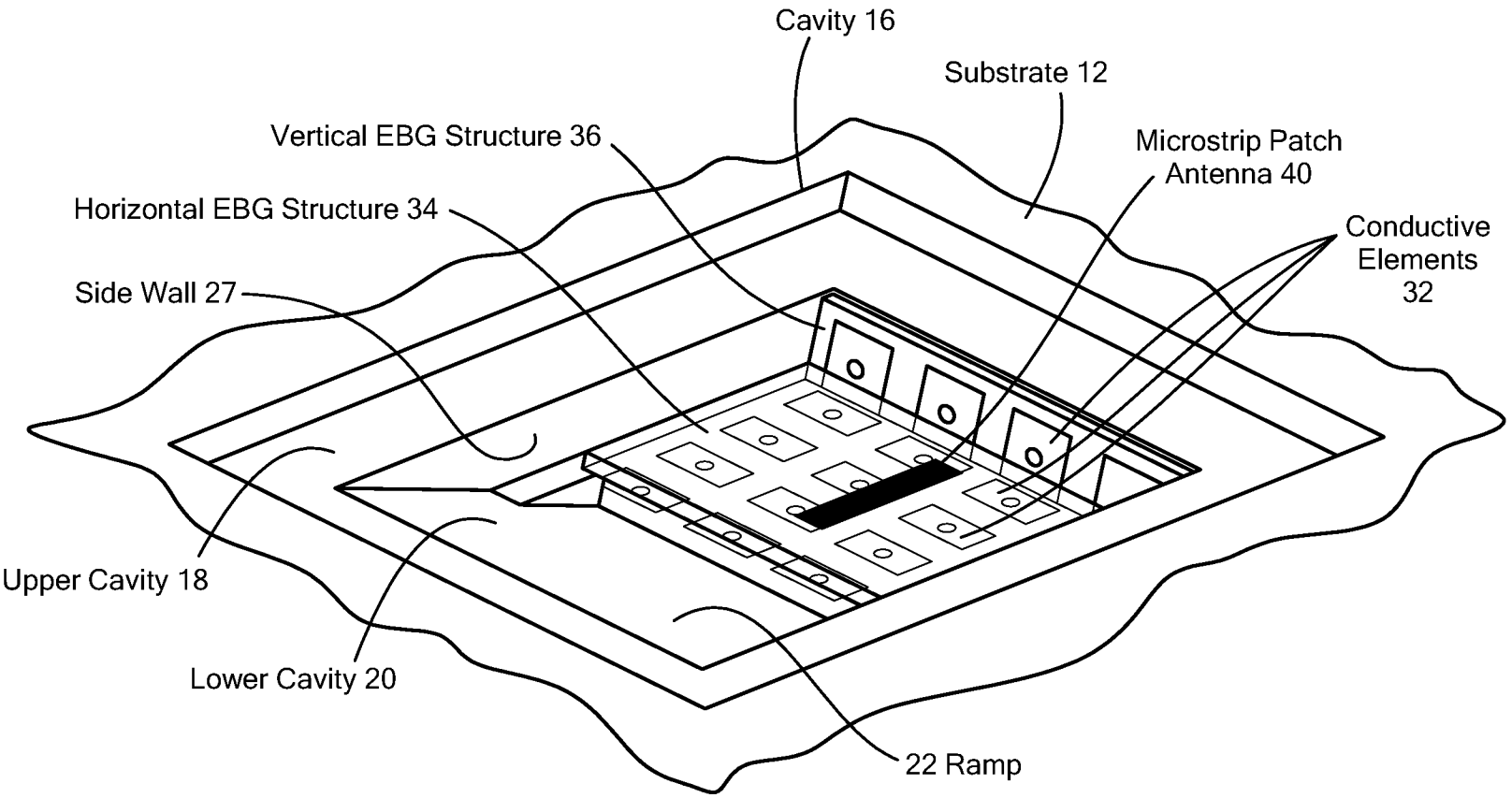
FIG. 2A is a top isometric view of a portion of ramp EBG antenna of FIG. 1 illustrating a ramped cavity in accordance with an illustrative embodiment.
Figure 2B:
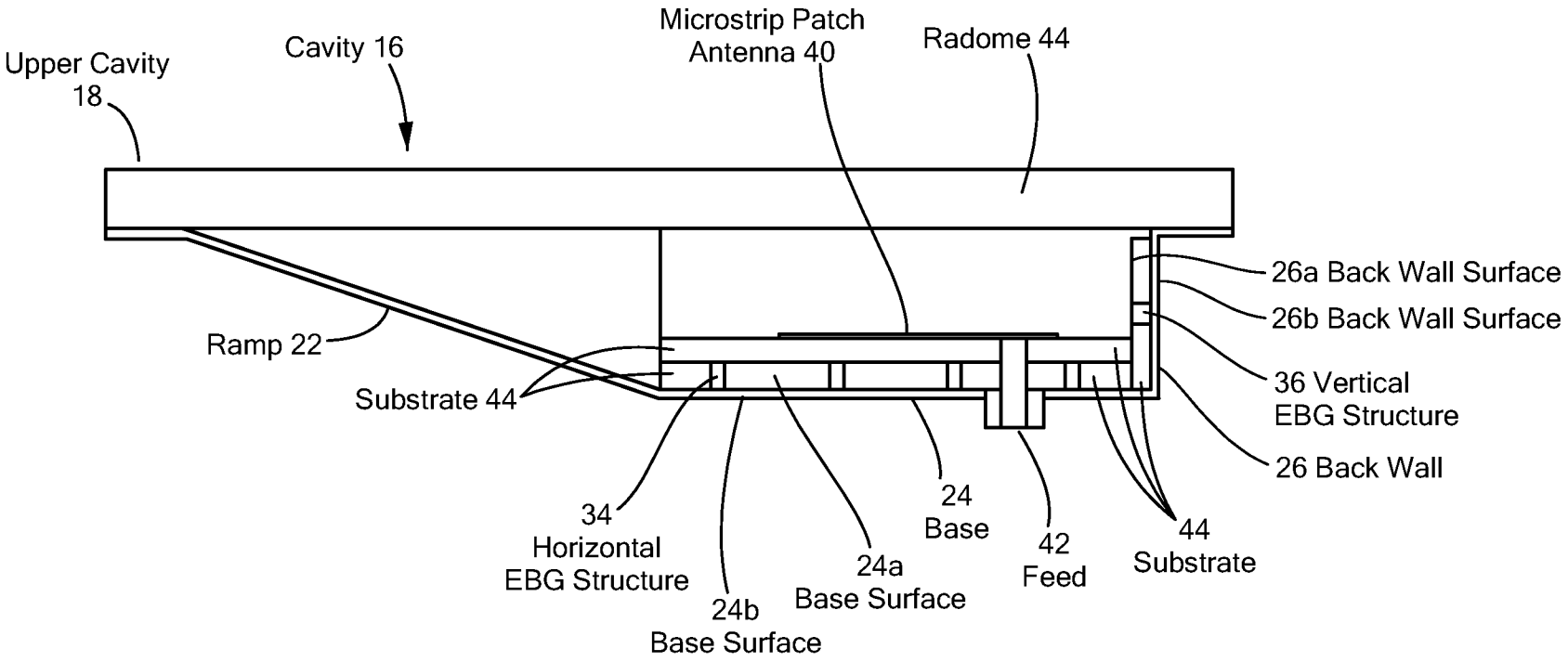
FIG. 2B is a cross-sectional view of the portion of the ramp EBG antenna of FIG. 2A.

The cavity 16, which will be described in greater detail below in conjunction with at least FIGS. 2A-2B, may be formed into or otherwise provided within the substrate 12 (e.g., using mechanical technique such as machining) and includes an upper cavity area 18 and a lower cavity area 20 (as shown in FIGS. 2A-2B). In some embodiments, the cavity 16 may be referred to as a conductive cavity. Although shown as in a center portion of the substrate 12, the cavity 16 may be provided at any point or portion of the substrate 12 to achieve desired antenna properties for any particular application. The cavity 16 includes a ramp portion 22 that extends from a surface of the upper cavity area 18 to a surface of the lower cavity area 20.

In some embodiments, the total ramp EBG antenna system 10 (including a radome over the ramped cavity 16) can be a flush-mounted on a larger structure (e.g., a missile body or a frame of a ground based or airborne vehicle.). In some embodiments, antenna 10 is provided having a small footprint and high volume efficiency (e.g., dimensions on the order of 1.3λ×0.69λ×0.24λ,) and a low-profile (e.g., 0.232" thick). However, the footprint and volume of the ramp EBG antenna system 10 may be scaled according to the requirement of a desired application and those of ordinary skill in the art will appreciate how to select and design appropriate dimensions to achieve desired antenna properties for any particular application. Other embodiments could include an air gap between the radiator layer and the radome layer for thermal control purposes. This airgap could be a flat layer if all other layers are planar or could be planar on the radiator side and curved on the radome side if the radome is also curved to allow the outer structure to be conformal.

Now referring to FIGS. 2A-2B, in which like elements of FIG. 1 are provided having like reference designations throughout the several views, includes an upper cavity portion 18 and a lower cavity portion 20. The upper cavity portion 18 may be configured to receive a protective layer or radome 44 to protect elements disposed within the cavity 16 (e.g., radiating element 40, horizontal EBG structure 34, vertical EBG structure 36). Radome 44 is flush with the first surface of the substrate when disposed on the upper cavity portion 16. For example, an upper surface of radome 44 can be substantially flush with an upper or top surface of the cavity 16. In some embodiments, radome 44 may be provided above the elements within the cavity 16 to, among other things, protect the radiating element 40 and other circuitry from an exterior environment. In one embodiment, radome 44 may be provided from a dielectric substrate laminated or otherwise disposed over the top of the radiating element.

Lower cavity portion 20 includes a ramp portion 22, a base portion 24 (FIG. 2B), a back wall 26, and side walls 27 (FIG. 2A). The ramp portion 22 may begin at a surface or lower edge of the upper cavity portion 18 and extend to a base portion 24 of the lower cavity area 20. The angle and length of the ramp portion 22 may vary depending on dimensions of other components of the ramp EBG antenna system 10. For example, the angle and length of the ramp portion 22 may be selected and designed based on the volume (i.e., depth) of the substrate and a desired antenna beam steering angle. For example, the angle of the ramp effects the radiation pattern and the angle can be varied depending on the pattern or amount of fixed beam steering desired. The conductive ramp portion 22, base portion 24, back wall 26 and side walls 27 and base 24, which form the cavity may be provided from a conductive material or alternatively may be provided from a dielectric material (e.g. an injection molded material) having a conductive layer disposed thereover.

In some embodiments, base portion 24 may be a substantially flat surface or parallel with a second surface (i.e., base) of the substrate. In other embodiments, base surface 24*a* may be angled (i.e., non-parallel) relative to base surface 24*b*. In this case, the angle at which base surface 24*a* meets back wall surface 26*a* is an angle other than 90°. In this case, a right angle (i.e., a 90° angle0 is formed where base surface 24*a* meets back wall surface 26*a* (i.e., between a surface of base 24 and a surface of back wall 26). The base portion 24 is bordered by the ramp portion 22, the back wall 26 and side walls 27 to form the lower cavity area 20. The back wall 26 and side walls 27 of the lower cavity area 20 may extend from a top surface or edge of the base portion 24 to the base or lowest edge of the upper cavity area 18. In some embodiments, the back wall 26 and side walls 27 may be configured such that they are substantially perpendicular to surface 24*a* of the base portion 24. In other embodiments, some or all of back wall 26 and side walls 27 may be configured such that one, some or all of such walls are not perpendicular with respect to surface 24*a* of base portion 24.

In an embodiment, disposed within the lower cavity area 20 is the EBG structure 30, which includes a horizontal EBG structure 34 and a vertical EBG structure 36. The horizontal EBG structure 34 is disposed over the base portion 24 of the cavity 16. The vertical EBG structure 36 is disposed along selective portions of the back wall 26 of the cavity 16. In some embodiments, the vertical EBG structure 36 is disposed along a bottom portion of the back wall 26 such that a top portion of the back wall 26 is exposed within the lower cavity 16. In some embodiments, the EBG structure 30 (i.e., horizontal EBG structure 34, vertical EBG structure 36) may be disposed to cover an entire surface of the base portion 24 and selective portions of the back wall 26. In other embodiments, only selective portions of the base portion 24 and the back wall 26 may be covered with the EBG structure 30. The EBG structure 30 will be described in greater detail with respect to FIG. 3 below.

Still referring to FIGS. 2A-2B, a radiating element 40 may be disposed over the EBG structure 30. In some embodiments, the radiating element 40 is disposed above the horizontal EBG structure 34. In some embodiments, the radiating element 40 is parallel to the horizontal EBG structure 34 and perpendicular to the vertical EBG structure 36. To facilitate operation with horizontally and vertically-polarized signals, the radiating element 40 may be aligned with respect to an axis of the conductive elements 32 of the EBG structure 30 (i.e., a central longitudinal axis of radiating element 40 is aligned with the x or y axes).

The radiating element 40 may be provided as a patch element, microstrip patch antenna, PIFA (Planar Inverted F Antenna), a dipole element, loop element, slot element, or a monopole element. Other elements may also be used. In general, the shape and dimensions of the radiating element 40 may vary to achieve desired antenna properties for any particular application. For example, the shape of the radiating element 40 may include but not limited to rectangular, square, hexagonal, triangular, elliptical, or circular. The radiating element 40 is positioned such that is substantially parallel with the EBG structure 30 and the base portion 24 and substantially perpendicular to the back wall 26. As shown in FIGS. 1-2B, the radiating element 40 is centrally positioned with respect to the EBG structure 30. However those of ordinary skill in the art will appreciate that the radiating element 40 may be positioned over various portions of the EBG structure 30 to achieve desired antenna properties for any particular application. For example, in some applications it may be desirable to offset radiating element 40 from a centrally location position over the EBG structure 30 to adjust beam steering angle.

A substrate layer 44 may be disposed between the radiating element 40 and the horizontal EBG structure 34. In some embodiments, the material of the substrate layer 44 may fill the gaps between individual conductive elements of the horizontal EBG structure 34 and the vertical EBG structure 36. The substrate 44 may be provided as a dielectric material or other form of electrically insulating material, for example a magneto-dielectric material or artificial dielectrics. In the illustrated embodiment, an elongated patch radiating element 140 is used in the ramp EBG antenna system 10. It should be appreciated, however, that any type of element may be used that can operate as a linear or circular polarized electric field source.

A feed circuit 42 may be coupled to radiating element 40 such that radio frequency (RF) signals may be coupled to/from the radiating element 40 from feed circuit 42. In some embodiments, the feed circuit 42 is provided from an RF coaxial signal path (i.e. it is a coaxial feed) having a first end coupled to radiating element 40 and extending through EBG structure 30 (i.e., horizontal EBG structure 34, vertical EBG structure 36) and ground plane 14 in a manner known to those of ordinary skill in the art. Other techniques for coupling RF signal to/from the radiating element 40 may alternatively be used. For example, feed circuit 42 may be implemented via a capacitive coupling technique. It should be appreciated that there are multiple ways in which to capacitively couple to the radiating element 40 and still achieve high gain and greater beam steering. It should be understood that for this capacitively coupled structure, the radiating element 40 need not be on the same layer as the EBG structure 30, but it could be on the same layer. The high gain and greater beam steering can then be achieved by following the techniques described herein.

Figure 3:
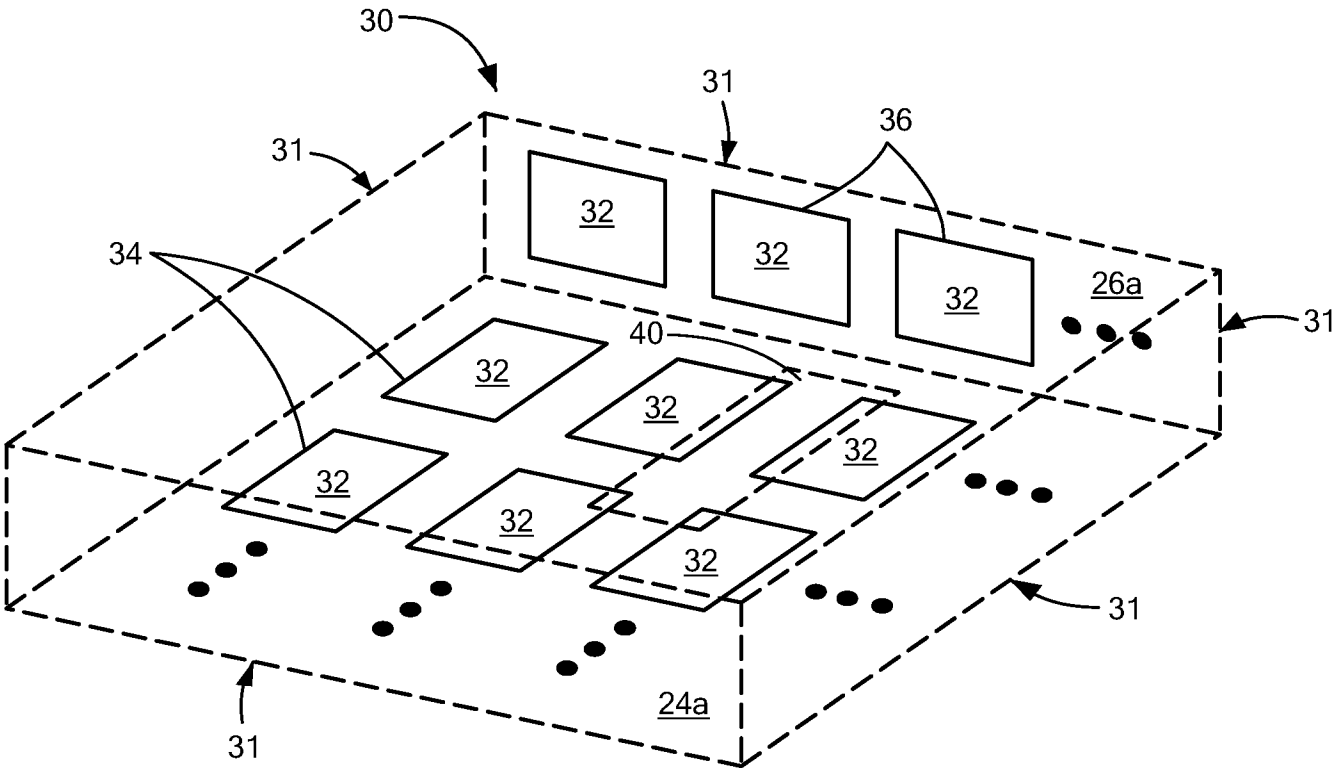
FIG. 3 is an isometric view of an EBG structure within a directive fixed beam ramp EBG antenna system in accordance with an illustrative embodiment.

Now referring to FIG. 3 an isometric view of an EBG structure within a directive fixed beam ramp EBG antenna system is shown. An outline of a portion of lower cavity 24 is shown in phantom and designated with reference numerals 31. The EBG structure 30 includes a plurality of horizontally and vertically disposed EBG elements 32 which may be arranged in a periodic fashion both horizontally and vertically within the ramped cavity (i.e., horizontal EBG structure 34, vertical EBG structure 36). The EBG elements 32 may be provided along the base portion 24 and the back wall surface 26*a* of the cavity. In some embodiments, the EBG elements 32 may be arranged in equally spaced rows and columns. For example, the EBG elements 32 may be arranged in a grid pattern over base and back wall surfaces 24*a*, 26*a*, e.g., a 4×4 pattern over the base portion 24 and in a 1×4 pattern along the back wall 26). In other embodiments, the EBG elements 32 may be arranged in a variety of patterns including, but not limited to triangular, circular, rectangular square patterns or a regular or irregular pattern may be used. In some embodiments, EBG elements 32 may be part of or form a unit cell. For example, EBG structure 30 includes a plurality of unit cells (e.g., EBG elements 32) disposed along the base portion 24 and the back wall surface 26*a* of the cavity.

The spacing between individual conductive elements 32 may be selected based on desired antenna properties for any particular application. For example, the spacing of the EBG elements can be used for tuning of the antenna to obtain the wide bandwidth. Thus, the spacing can be selected based upon a desired bandwidth. In some embodiments, the spacing may be chosen at an initial design phase when analyzing the in-phase reflection and surface wave band gap. Once the EBG structures were implemented into the design the spacing provides another tuning feature to match the antenna and optimize the desired fixed beam steering. In a typical EBG structure, there will be a capacitance between adjacent pairs of elements 32. During the design process, the cavity may be thought of as providing additional capacitance (e.g., capacitance between the walls of the cavity and the outermost elements 32 of the EBG structure 30) that can be used as a degree of freedom in the design. This capacitance may be adjusted by, for example, changing the distance between the cavity walls (i.e., back wall 26, side walls, ramp 22) and the outermost elements 32 of the EBG structure 30. It was found that by appropriately selecting this capacitance, the EBG structure 30 could be made to appear as though it had an image of additional rows and columns of conductive elements 32. By making the EBG structures 30 appear larger, the effective aperture appears electrically larger thereby providing the antenna having enhanced gain and impedance bandwidth relative to other antennas having the same size aperture. Properly selected, with the proper radiating mechanism, radiating position, dielectric constant, and cavity size, as described herein above, beam steering can be achieved.

Elements 32 may be provided from any type of conductive material or from a substantially non-conductive base material made to be conductive (e.g., via a metallization or doping process). Although elements 32 in FIGS. 1-4 are shown as having a square shape and arranged in a periodic pattern, the elements 32 may be provided having other shapes including but not limited to rectangular, hexagonal, triangular, elliptical, or circular. Additionally, other patterns or arrangements of unit cells may be provided including but not limited to a rectangular or triangular lattice, or disposed in any lattice pattern having a regular or irregular shape with regular or irregular spacing. Patterns including but not limited to rectangular, hexagonal, triangular, elliptical, or circular may be used. The size, shape, lattice pattern, and proximity (e.g., spacing) of the various elements 32 will, to a large extent, dictate the operational properties of the EBG structure 30. Those of ordinary skill in the art will appreciate how to select the size and shape of the elements 32 to achieve desired antenna properties for any particular application (e.g., using analytical and/or empirical techniques).

In some embodiments, the EBG elements 32 proximate to the feed circuit are a different size (i.e., smaller, different shape) than other ones of EBG elements 32. The size and shape of elements 32 can be selected to facilitate fabrication of EBG antenna assembly (e.g. to prevent coaxial feed from electrically contacting elements 32) and also to provide a tuning structure to improve the impedance bandwidth of the EBG antenna assembly over a desired bandwidth and also to reduce mechanical interference between the feed circuit and/or radiating element and elements 32. The amount by which the size of elements 32 proximate to the feed circuit 42 may be reduced is highly dependent upon a variety of factors including but not limited to: the radiating mechanism, dielectric constant, cavity size, cavity depth, frequency of operation, etc.

In some embodiments, the elements 32 are formed above a ground plane (i.e., base of the substrate 12). Each element 32 may include a structure that is conductively coupled to the ground plane by a conductive connection 50 which may, for example, be provided as a plated through hole having a first end coupled to the conductive EBG element and a second end coupled to the ground plane. In some embodiments, the horizontal EBG structure 34 and the vertical EBG structure 36 are a particular form of EBG structure known as a mushroom EBG.

In an embodiment, to achieve enhanced performance characteristics, the radiating element 40, the horizontal EBG structure 34, the vertical EBG structure 36, and the ramp 22 in the cavity 16 are designed together. By simultaneously designing these elements a significant improvement in gain near the horizon and improvement in steered gain by 10° (compared to without ramp). Traditionally, it has been considered a detriment to mount an antenna within a cavity. That is, the overall performance of the resulting antenna was invariably thought to be worse than the performance of the same antenna without a cavity. It has been found, however, that careful design of all elements together can result in an antenna within a ramped cavity that has performance characteristics that exceed those of a similar antenna without a ramped cavity or any cavity for that matter.

In some cases, an antenna can be achieved that performs like a much larger antenna, but within a smaller, more compact package. The antenna design must take into account the effects that the ramped cavity may have on the operation of other components of the antenna. This may include, for example, performance effects caused by capacitances between the back wall and side walls of the cavity 16 and the elements 32 of the EBG structure 30. In some embodiments, this may also include performance effects of capacitances between the back wall and side walls of the cavity 16 and the radiating element 40. In at least one implementation, the ramped cavity 40 is used as an additional design variable to tune the antenna system 10 for broadband operation. It was found that careful design of radiating mechanism, its position, etc. as described hereinabove, results in the described beam steering capability. It should be appreciated that the antenna assemblies and antennas described herein requires only standard printed circuit board (PCB) materials and fabrication processes. Thus, the antenna assemblies and antennas described herein could be mass produced with low cost.

The techniques and structures described herein may be used, in some implementations, to generate conformal antennas or antenna arrays that conform to a curved surface on the exterior of a mounting platform (e.g., a missile, an aircraft, etc.). When used in conformal applications, the structures described above can be re-optimized for a conformal cavity. Techniques for adapting an antenna design for use in a conformal application are well known in the art and typically include re-tuning the antenna parameters for the conformal surface.

The antenna designs and design techniques described herein have application in a wide variety of different applications. For example, the antennas may be used as active or passive antenna elements for missile sensors that require bandwidth, higher gain to support link margin, and wide impedance bandwidth to support higher data-rates, within a small volume. They may also be used as antennas for land-based, sea-based, satellite, or mobile communications. Because antennas having small antenna volume are possible, the antennas are well suited for use on small missile airframes. The antennas may also be used in, for example, handheld communication devices (e.g., cell phones, smart phones, etc.), commercial aircraft communication systems, automobile-based communications systems (e.g., personal communications, traffic updates, emergency response communication, collision avoidance systems, etc.), Satellite Digital Audio Radio Service (SDARS) communications, proximity readers and other RFID structures, radar systems, global positioning system (GPS) communications, and/or others. In at least one embodiment, the antenna designs are adapted for use in medical imaging systems. The antenna designs described herein may be used for both transmit and receive operations. Many other applications are also possible.

Having described exemplary embodiments of the invention, it will now become apparent to one of ordinary skill in the art that other embodiments incorporating their concepts may also be used. The embodiments described herein should not be limited to disclosed embodiments but rather should be limited only by the spirit and scope of the appended claims. All publications and references cited herein are expressly incorporated herein by reference in their entirety.

What is claimed:

1. An antenna comprising:

a substrate having first and second opposing surfaces with the first surface having a cavity provided therein, the cavity having a ramp portion, a base portion, a sidewall portion, and a back wall portion;

a ground plane disposed over selected portions of the first surface away from the cavity;

a first electromagnetic band gap (EBG) structure disposed about the base portion of the cavity, the EBG structure having a plurality of unit cells; and a radiating element disposed above the first EBG structure.

2. The antenna of claim 1, wherein a height of the back wall portion and the side wall portion is equal to a highest point of the ramp portion.

3. The antenna of claim 1, further comprising a second EBG structure disposed on the back wall portion of the cavity.

4. The antenna of claim 3, wherein a plane in which the radiating element is disposed parallel to a surface of the first EBG structure and perpendicular to a surface of the second EBG structure.

5. The antenna of claim 1 further comprising a dielectric layer disposed between the radiating element and the EBG structure.

6. The antenna of claim 1, further comprising a feed circuit coupled to the radiating element.

7. The antenna of claim 1, further comprising a radome disposed over the substrate cavity.

8. The antenna of claim 1, wherein an upper surface of the radome is substantially flush with an upper surface of the substrate in which the cavity is provided.

9. The antenna of claim 1, wherein the first EBG structure comprises a plurality of EBG elements, and wherein the plurality of EBG elements are spaced a predetermined distance from each other to provide a predetermined capacitance between the plurality of EBG elements.

10. The antenna of claim 3, wherein the second EBG structure comprises a plurality of EBG elements.

11. An antenna comprising:

a substrate having first and second opposing surfaces with the first surface having a cavity provided therein, the cavity having a base portion, a sidewall portion, and a back wall portion;

a ground plane disposed over selected portions of the first surface away from the cavity;

a first electromagnetic band gap (EBG) structure disposed about the base portion of the cavity, the first EBG structure having a plurality of unit cells;

a second EBG structure disposed on the back wall portion of the cavity, the second EBG structure having a plurality of unit cells; and a radiating element disposed above the first EBG structure.

12. The antenna of claim 11, wherein the cavity further comprises a ramp portion.

13. The antenna of claim 12, wherein a height of the back wall portion and the side wall portion is equal to a highest point of the ramp portion.

14. The antenna of claim 13, wherein a plane in which the radiating element is disposed parallel to a surface of the first EBG structure and perpendicular to a surface of the second EBG structure.

15. The antenna of claim 11 further comprising a dielectric layer disposed between the radiating element and the EBG structure.

16. The antenna of claim 11, further comprising a feed circuit coupled to the radiating element.

17. The antenna of claim 11, further comprising a radome disposed over the substrate cavity.

18. The antenna of claim 11, wherein an upper surface of the radome is substantially flush with an upper surface of the substrate in which the cavity is provided.

19. The antenna of claim 11, wherein the first EBG structure comprises a plurality of EBG elements.

20. The antenna of claim 11, wherein the second EBG structure comprises a plurality of EBG elements.

* * * * *